US005365913A

United States Patent [19]

Walton

[11] Patent Number: 5,365,913

[45] Date of Patent: Nov. 22, 1994

[54] RUPTURE DISC GAS LAUNCHER

[76] Inventor: Garry L. Walton, 2818 Bayview St., British Columbia, Canada V4A 2Z4

[21] Appl. No.: 93,758

[22] Filed: Jul. 20, 1993

[51] Int. Cl.[5] ..... F41B 11/00

[52] U.S. Cl. ..... 124/75; 124/60; 89/1.8

[58] Field of Search ..... 89/1.818, 1.8; 124/75, 124/73, 69, 60

[56] References Cited

U.S. PATENT DOCUMENTS

| | | | |
|---|---|---|---|
| 344,936 | 7/1886 | Bartlett | 124/73 |
| 422,347 | 2/1890 | Hyde | 124/60 |
| 2,581,758 | 11/1952 | Galliano et al. | 124/75 |
| 2,780,213 | 2/1957 | Colling et al. | 124/75 |
| 3,039,450 | 6/1962 | Scala | 124/60 |
| 3,422,808 | 1/1969 | Stein et al. | 124/77 |
| 3,496,925 | 2/1970 | Myers | 124/61 |
| 3,536,054 | 10/1970 | Stephens et al. | 124/60 |
| 3,583,381 | 6/1971 | Eaton | 124/73 |
| 4,951,644 | 8/1990 | Bon | 89/1.8 |

FOREIGN PATENT DOCUMENTS

| | | |
|---|---|---|
| 27050 | 6/1887 | Canada . |
| 1976692 | 12/1916 | Canada . |
| 499117 | 1/1954 | Canada . |
| 683503 | 3/1964 | Canada . |
| 968656 | 6/1975 | Canada . |

*Primary Examiner*—David Brown

[57] ABSTRACT

This invention relates to pneumatic guns that use a source of compressed gas to launch a projectile toward a target. A variety of trigger mechanisms have been used to apply the compressed gas to the base of the projectile in such a gun. In the present invention, replaceable discs of known rupture pressure threshold are mounted in the gas launcher between a compressed gas chamber and the launch tube. The gas launcher launches its projectile by the operator causing the pressure in the launcher to build up to the rupture threshold of the replaceable disc, at which point the disc ruptures and the compressed gas escapes from the compressed gas chamber past the rupture disc to push the projectile out of the launch tube. The rupture disc is a metal disc of known burst pressure. When the disc ruptures, the resulting disc segments are pressed by the outflow of compressed gas against an electrical contact to switch on an arming circuit for a delayed detonator in the explosive payload of the projectile that is launched from the gas launcher.

12 Claims, 4 Drawing Sheets

RUPTURE DISC GAS LAUNCHER

FIELD OF THE INVENTION

This invention relates to pneumatic launchers that use a source of compressed gas to launch a projectile toward a target. Such launchers are useful in situations where it is unnecessary or impractical to use an explosive charge to launch the projectile. A gas launcher requires no such charge, and is typically of lighter weight than a corresponding explosive charge launcher, which requires metal breech and barrel components to contain and direct the explosive charge. Pneumatic launchers are typically quieter than guns that fire by means of explosive charges. Manipulation of the pressure of the launching gas prior to firing provides control over a range of target distances for the projectiles used in such guns.

DESCRIPTION OF THE PRIOR TECHNOLOGY

It is common to have a pneumatic gun comprising a gun barrel connected to a pressurized gas reservoir and a trigger mechanism by which a quantity of pressurized gas can be delivered to the gun barrel in order to propel a projectile from the gun barrel toward some target. The trigger mechanism can be connected to open a valve that releases pressurized gas into the gun barrel from a reservoir or from an intermediate storage chamber that has been fed from the reservoir until a desired pre-trigger pressure has been reached. Complicated piston and breech valve assemblies have been used in conjunction with multiple pressure chambers to enable the manipulation of pressure differentials to effect opening of a valve mechanism and thereby the shooting of a projectile from such a gun. Additional variations include a pneumatic gun that uses a low pressure tube separating the compressed gas in a chamber from a projectile in a gun barrel by means of frangible diaphragms that rupture to fire the gun upon the gaseous pressure in the low pressure tube being sufficiently lowered.

SUMMARY AND OBJECTS OF THE PRESENT INVENTION

In the gas launcher of the present invention, replaceable discs of known rupture pressure threshold are mountable in the gas launcher between a compressed gas chamber and a launch tube. The gas launcher launches its projectile upon the operator supplying compressed gas from a compressor to the compressed gas chamber, causing the pressure there to build up to the rupture threshold of the frangible disc, at which point the disc bursts and the compressed gas escapes past the rupture disc to expel the projectile from the launch tube. The rupture disc is scored on the projectile side to provide a predetermined flap pattern upon rupture. When the disc bursts the resulting flaps are pressed back by the outflow of compressed gas and can be used in conjunction with an electrical contact as a switch to complete an arming electrical circuit for a delay detonator in the explosive projectile that is launched from the gas launcher.

The gas launcher can be used in a variety of situations. For example in an underground mine, it can be used to lob explosive charges at a jammed rock slide, large boulder, or other target that is a sufficient distance away from the launcher such that the gas launcher itself is unlikely to be damaged in the ensuing explosion.

Furthermore, the gas launcher can be remotely triggered by having the compressor or the compression controls at a distance from the gas launcher, connected to the gas launcher by a gas hose.

The gas launcher can be used with an aerodynamically shaped or non-shaped charge, depending on the force required for the situation. In order to accommodate the diverse requirements of mining, various weights and power of explosive projectile can be used in conjunction with a variety of replaceable rupture discs to achieve the desired distance and blast in accordance with well known ballistics and blast principles.

A typical configuration for the gas launcher of the present invention would be to have an inside diameter of the launch tube of 111 millimeters, to accommodate a projectile having an outside diameter of 110 millimeters. The 1 millmeter clearance allows some slippage of gas past the projectile as it is expelled from the launch tube, providing a gaseous bearing and reducing friction and wear in the launch tube. The inside diameter of the opening sealed by the rupture disc between the compressed gas chamber and the launch tube would be 110 millimeters in order to provide unconstricted outflow of the compressed gas upon the base of the projectile, subject only to the electrical contact ring protruding somewhat into the opening. An electrical contact ring having an inside diameter of 105 millimeters is sufficient to enable the rupture disc to make contact while having a minimal constrictive effect on the outflow of compressed gas to launch the armed projectile.

The launcher can be aimed by eye or by a light inside the launch tube and its elevation set by adjusting a simple bipod supporting the launcher.

DETAILED DESCRIPTION

Figure 1:
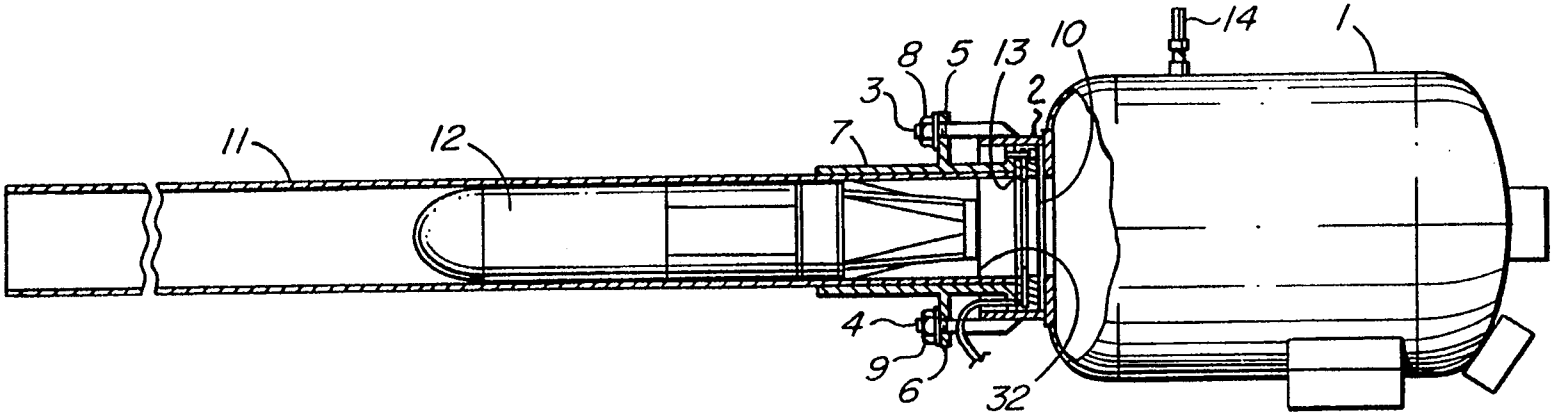
FIG. 1 is a cross-sectional side view of the rupture disc gas launcher loaded with a projectile.

Referring to FIG. 1, the rupture disc gas launcher comprises a compressed gas storage tank 1 upon which is mounted a rupture disc receptacle tube 2 with retaining bolts 3 and 4 adapted to receive the holes formed within flanges 5 and 6 respectively on the rupture disc retention tube 7. The nuts 8 and 9 have been tightened onto the bolts 3 and 4 respectively to keep the rupture disc 10 in position at the base of the rupture disc retention tube 7. A launch tube 11 fits within the rupture disc retention tube 7. A projectile 12 fits within the launch tube 11. The rupture disc receptacle tube 2 rests on the outer edge of the base ring 13 within the rupture disc retention tube 7. The base ring 13 is made of compressive and electrically insulative material such as neoprene, in which is embedded a contact ring of electrically conductive material such as brass. The contact ring is exposed around the inside circumference of the base ring. The neoprene material is compressed by tightening the nuts 8 and 9 to compress and seal the rupture disc in position blocking the opening from the compressed gas storage tank 1. The compression material absorbs some shock and provides a more even pressure release when the rupture disc 10 bursts. The nuts 8 and 9 and the bolts 3 and 4 are but two of a multiple nut and bolt pattern, for example, a five bolt pattern around the the rupture disc retention tube 7. The projectile 12 has its base resting on a retaining wire 32 at the base of the launch tube 11. The retaining wire keeps the projectile's base off the electrical arming circuit and the rupture disc, and provides an affixation point for a snap hook at the end of any safety arming wire that may also be attached to an additional safety arming circuit within the projectile until the projectile is ejected from the gas launcher at least the length of the safety arming wires, in order to allow detonation of the projectile upon the safety arming wire going taut when the projectile has been expelled the length of the safety arming wire from the rupture disc gas launcher. The compressed gas storage tank 1 has a nipple 14 for receiving a compressed gas hose end adaptor whereby the storage tank 1 can be pumped up with gas from a compressed gas source until the rupture disc 10 bursts, at which point the projectile is launched.

Figure 2:
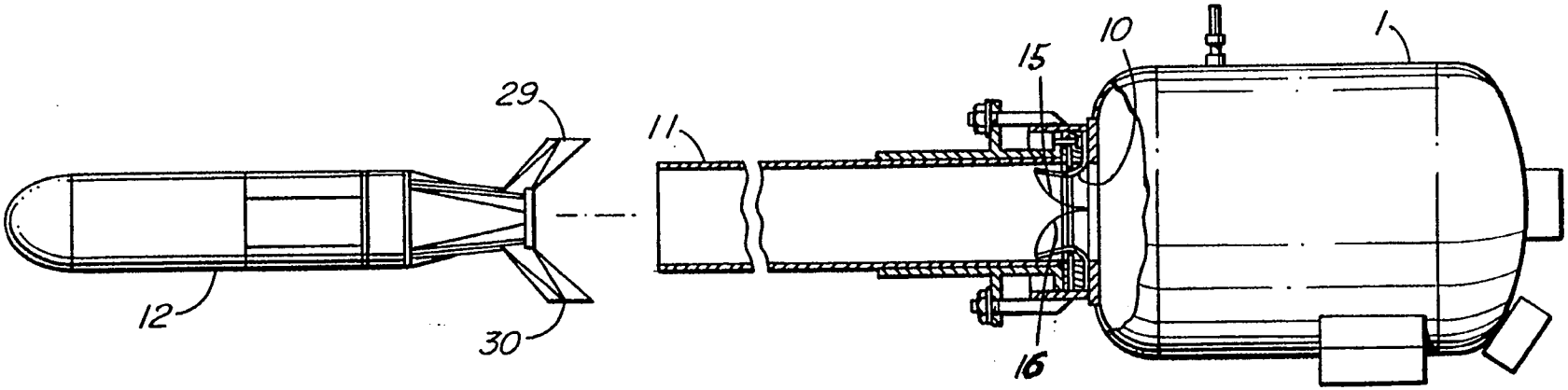
FIG. 2 is a cross-sectional side view of the device of FIG. 1, with the disc ruptured and the projectile expelled from the gas launcher.

Referring to FIG. 2, when the pressure in the compressed gas storage tank 1 is sufficient, the rupture disc 10 bursts along arcs 15 and 16, and the gas expels the projectile 12 from the launch tube 11 in the direction in which the launch tube has been aimed. The projectile 12 has spring-loaded fins 29 and 30 that are compressed when the projectile is loaded into the launch tube and that spring out for flight stabilization when the projectile is launched out of the gas launcher.

Figure 3:
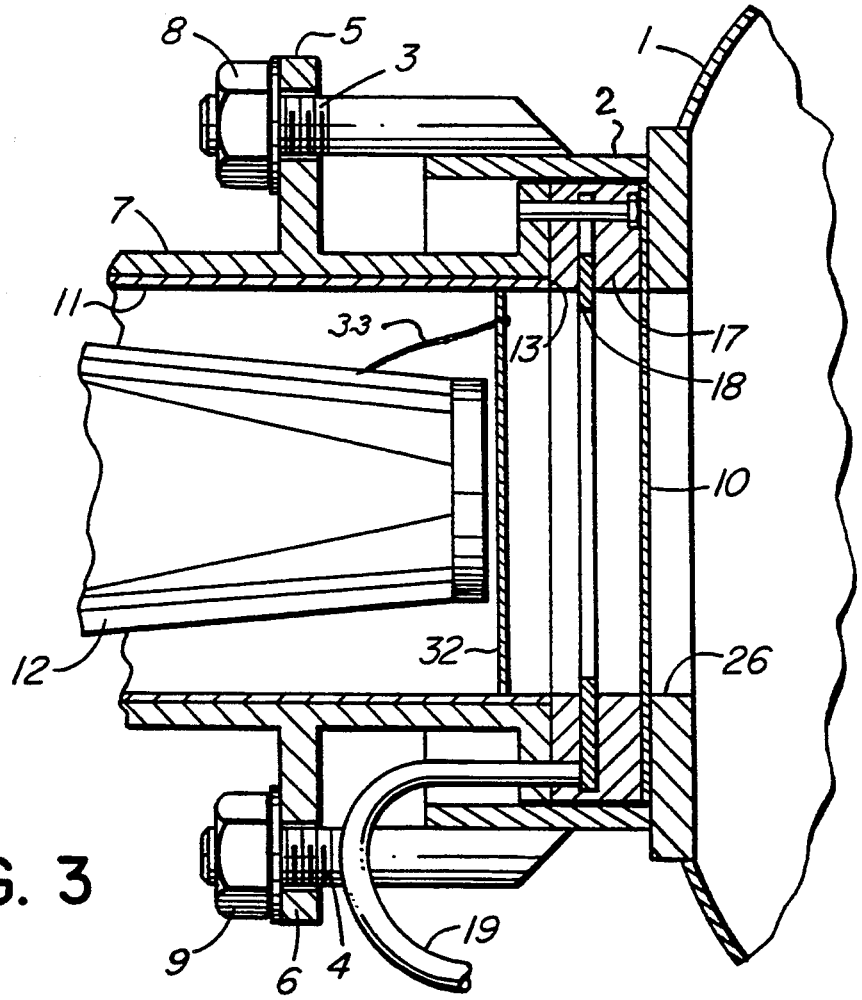
FIG. 3 is a cross-sectional view of the rupture disc mounted in the device of FIG. 1, prior to firing the gas launcher.

Referring to FIG. 3, the rupture disc gas launcher comprises a compressed gas storage tank 1 upon which is mounted a rupture disc receptacle tube 2 with retaining bolts 3 and 4 adapted to receive the holes formed within flanges 5 and 6 respectively on the rupture disc retention tube 7. The nuts 8 and 9 have been tightened onto the bolts 3 and 4 respectively to keep the rupture disc 10 in position at the base of the rupture disc retention tube 7. The projectile 12 fits within the launch tube 11. The projectile 12 has its base adjacent to a retaining wire 32 within the launch tube 11. The base ring 13 of the rupture disc retainer tube 7 has an electrically insulative layer 17, made of neoprene, for example, and enclosing a ring 18, made of brass, for example. The brass ring is connected via wire 19 to the ground side of the arming circuit. The safety arming attaches the projectile 12 to the retaining wire 32.

Figure 4:
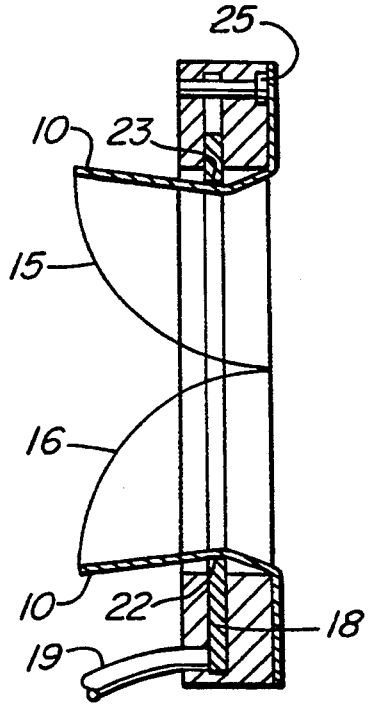
FIG. 4 is a cross-sectional view of the disc ruptured within the device of FIG. 1, after the gas launcher has been fired.

Referring to FIG. 4, when the rupture disc 10, bursts along arcs 15 and 16, it presses against the brass ring 18 at points 22 and 23, for example, and completes the electrical circuit between the grounded tank 1 through the interface of the contact between the rupture disc receptacle tube 7 and the unbroken circumference of the electrically conductive rupture disc 10 and through wire 19. When the rupture disc, bursts out to contact the brass ring 18 embedded in the base ring 13 the rupture disc 10, which in a preferred embodiment comprises nickel, thereby acts as an electrical switch which is used to activate a delay detonating circuit circuit within the projectile 12, provided the wire 19 is connected to the negative side of the arming circuit, that the negative electrode of the battery is detachably connected to the tank 1, and the other terminal of the circuit is detachably connected to the positive electrode of the battery. When the rupture disc 10 bursts, the outflow of compressed gas expels the projectile 12 up the launch tube 11, and simultaneously arms the detonator circuit within the projectile.

Figure 5:
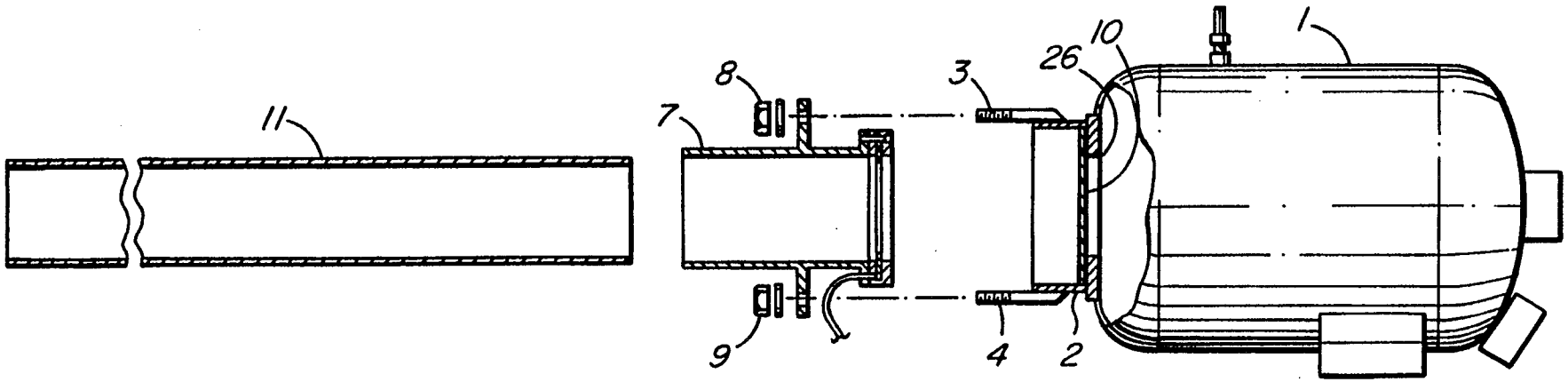
FIG. 5 is a cross-sectional side view of the device of FIG. 1 with the launch tube and the rupture disc retention tube detached for replacement of a rupture disc.

Referring to FIG. 5, the Launch tube 11 and the rupture disc retention tube 7 can be detached from the rupture disc receptacle tube 2 mounted to the compressed gas storage tank 1, in order to place a new rupture disc 10 into position over the opening formed at rim 26 to the compressed gas storage tank 1. The device can then be loaded with a projectile and reassembled by tightening the nuts 8 and 9 over the flanges 5 and 6 onto the bolts 3 and 4 respectively. The launch tube 11 and the rupture disc retention tube 7 could alternatively be of one-piece construction for simplicity or of multiple-section construction for disassembly and packing for transportation to a work site.

Figure 6:
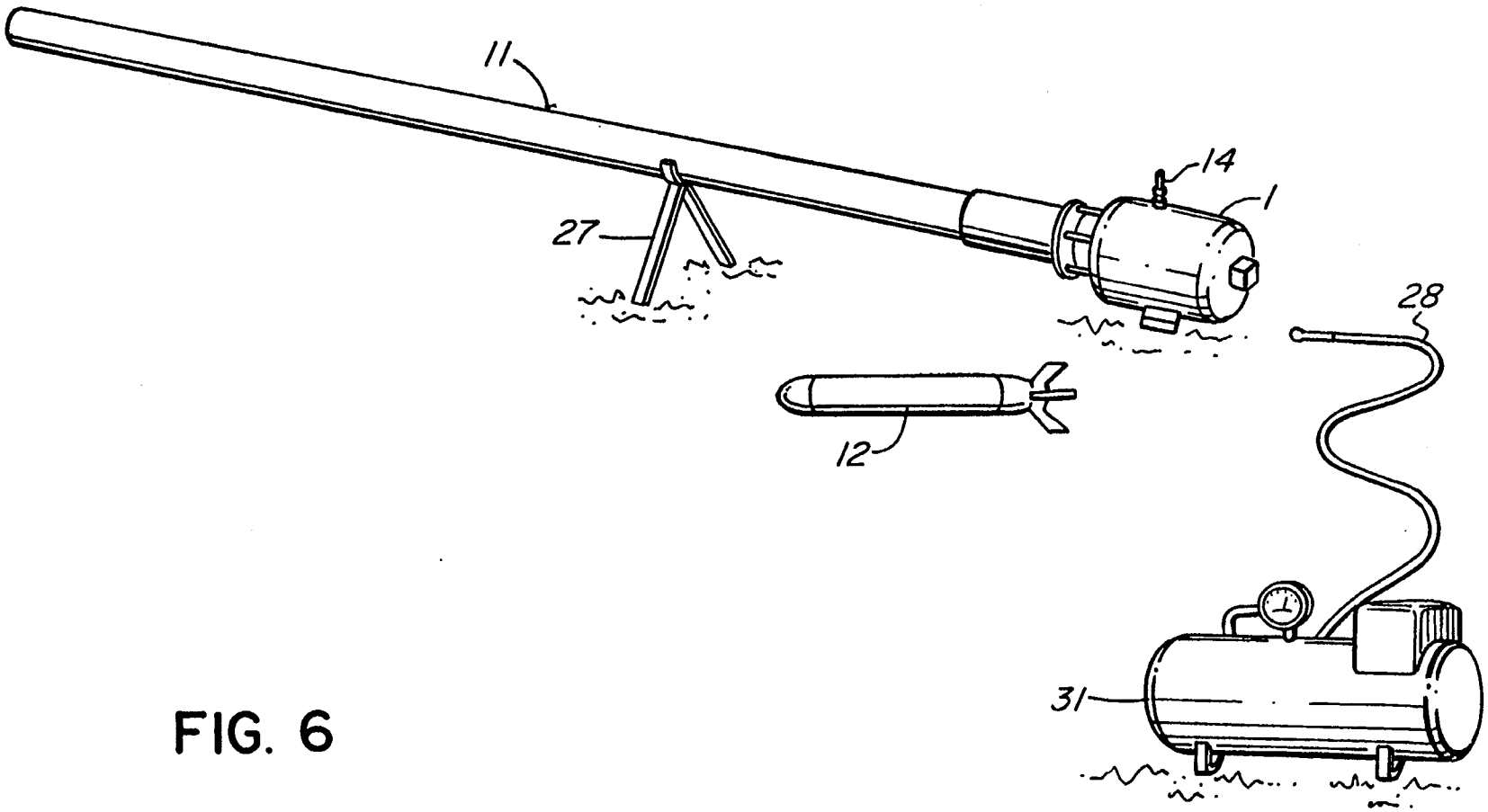
FIG. 6 is a perspective of the device of FIG. 1, mounted on a bipod and ready for use.

Referring to FIG. 6, the rupture disc gas launcher can be aimed and adjusted as to elevation by means of a simple bipod 27 slidably attached to the launch tube 11. An gas hose 28 attached to the nipple 14 supplies compressed gas to the compressed gas storage tank 1 by means of a compressor 31 that can be remote from the gas launcher or remotely controlled by the operator of the gas launcher.

It will be apparent that the use of a variety of rupture discs of known burst pressure will give the operator a selection over a variety of ranges to which projectiles of a given weight can be launched by the gas launcher.

The within-described invention may be embodied in other specific forms and with additional options and accessories without departing from the spirit or essential characteristics thereof. The presently disclosed embodiment is therefore to be considered in all respects as illustrative and not restrictive, the scope of the invention being indicated by the appended claims rather than by the foregoing description, and all changes which come within the meaning and range of equivalence of the claims are therefore intended to be embraced therein.

I claim:

1. A rupture disc gas launcher comprising:

a) a compressed gas storage tank, having means for receiving compressed gas from a compressed gas source;

b) a rupture disc receptacle tube mounted to the compressed gas storage tank;

c) a rupture disc that bursts at a known gas pressure range being reached and that fits into the rupture disc receptacle tube to block it until it bursts upon the known gas pressure range being reached;

d) a rupture disc retention tube that detachably fits within the rupture disc receptacle tube in order to retain the rupture disc in a compressed gas blocking position within the rupture disc receptacle tube;

e) detachable mounting means for holding the rupture disc retention tube in a detachably fitted position within the rupture disc receptacle tube despite compressed gas pressure and for allowing the replacement of the rupture disc that after a launching with the rupture disc gas launcher;

f) a launch tube mounted to the rupture disc retention tube for guiding a projectile launched from the rupture disc gas launcher.

2. The rupture disc gas launcher of claim 1, in which a surface of the rupture disc has scored lines to cause the rupture disc to burst along the scored lines upon the known gas pressure range being reached.

3. The rupture disc gas launcher of claim 1, in which the rupture disc gas launcher is adjustably mounted on a bipod in order to allow a user to aim and set the rupture disc gas launcher at a variety of elevation settings.

4. The rupture disc gas launcher of claim 1, in which the the detachable mounting means comprises a number of bolts, receiving flanges, and nuts by which the nuts can be tightened down the bolts mounted to one tube to hold the flanges mounted onto another tube.

5. The rupture disc gas launcher of claim 1, in which the rupture disc receptacle tube has a base ring comprising an electrically insulative layer embedding a contact ring of electrically conductive material exposed on the inner circumference of the base ring, the rupture disc receptacle tube being detachably fitted to abut an outer edge of the base ring, the rupture disc abutting the insulative layer of the base ring, the rupture disc comprising electrically conductive material, in order that at least one segment of the rupture disc can act as a switch to close a projectile delayed detonator arming electrical circuit upon the rupture disc bursting open.

6. The rupture disc gas launcher of claim 5, in which the base ring is connected to an electrically conductive wire for connection to a battery.

7. The rupture disc gas launcher of claim 5, in which the electrically insulative layer of the base ring comprises neoprene, in which the electrically conductive layer of the base ring comprises brass, and in which the rupture disc comprises nickel.

8. The rupture disc gas launcher of claim 1, including a projectile for launching from the launch tube, in which a retaining wire adapted to receive the base of the projectile extends across a base portion of the launch tube.

9. The rupture disc gas launcher of claim 8, in which the diameter of the projectile is approximately 1 millimeter less than the diameter of the launch tube, in order to provide a gaseous bearing to reduce friction within the launch tube.

10. The rupture disc gas launcher of claim 8, in which a safety arming wire joins the projectile to the rupture disc gas launcher, in order to allow detonation of the projectile upon the safety arming wire going taut when the projectile has been expelled the length of the safety arming wire from the rupture disc gas launcher.

11. The rupture disc gas launcher of claim 8, in which the compressed gas storage tank is connected by an gas hose to an gas compressor having controls by which the supply of compressed gas to the rupture disc gas launcher can be remotely controlled and the projectile launched from the rupture disc gas launcher.

12. The rupture disc gas launcher of claim 8, in which a) a safety arming wire joins the projectile to the rupture disc gas launcher, in order to allow detonation of the projectile upon the safety arming wire going taut when the projectile has been expelled the length of the safety arming wire from the rupture disc gas launcher;

b) the compressed gas storage tank is connected by an gas hose to an gas compressor having controls by which the supply of compressed gas to the rupture disc gas launcher can be remotely controlled and the projectile launched from the rupture disc gas launcher;

c) the electrically insulative layer of the base ring comprises neoprene, in which the electrically conductive layer of the base ring comprises brass, and in which the rupture disc comprises nickel;

d) the rupture disc gas launcher is adjustably mounted on a bipod in order to allow a user to aim and set the rupture disc gas launcher at a variety of elevation settings;

e) the detachable mounting means comprises a number of bolts, receiving flanges, and nuts by which the nuts can be tightened down the bolts mounted to one tube to hold the flanges mounted onto another tube.

* * * * *